United States Patent [19]

Olthoff

[11] 3,981,315

[45] Sept. 21, 1976

[54] STIRRING APPARATUS FOR A LIQUID TANK

[75] Inventor: Klaas Olthoff, Leek, Netherlands

[73] Assignee: Alfa-Laval N.V., Groningen, Netherlands

[22] Filed: Sept. 30, 1974

[21] Appl. No.: 510,789

[52] U.S. Cl. ..... 134/167 R

[51] Int. Cl.[2] ..... B08B 3/00; B08B 9/00

[58] Field of Search ..... 259/106, 107, 105, 110, 259/108; 134/167 R, 167 C; 99/460, 466

[56] References Cited

UNITED STATES PATENTS 3,402,725 9/1968 Booth ..... 134/167 R

*Primary Examiner*—Stanley N. Gilreath
*Assistant Examiner*—Donald B. Massenberg
*Attorney, Agent, or Firm*—O'Brien & Marks

[57] ABSTRACT

The invention relates to a stirring and cleaning apparatus for a liquid tank, e.g. a milk tank, said stirring apparatus comprising a rotatable, motor-driven hollow stirring shaft disposed in the tank, which shaft is provided at the bottom with stirring paddles and at its top is connected to a pipe for pressure liquid and at its bottom being provided moreover with upwardly directed spray orifices.

3 Claims, 2 Drawing Figures

STIRRING APPARATUS FOR A LIQUID TANK

The invention relates to a stirring apparatus for a liquid tank, comprising a driven shaft extending downwardly in the tank, to which shaft are attached stirring paddles. Such stirring apparatus are known, in particular for milk cooling tanks used by cattle raisers for the provisional storage of milk. Each time after milking the milk collected from the cattle is emptied in the tank and cooled. After 4–6 milking turns the tank is emptied however and the milk is conducted to the dairy factory for further processing. After emptying the tank has to be cleaned, which has been effected hitherto by means of some spraying system which is lowered into the tank from above.

It is an object of the present invention to provide an improved milk tank cleaning apparatus. To this effect the stirring shaft according to the invention is hollow, and connected at the top end to a supply pipe of pressurized liquid and at the bottom end provided with upwardly directed spray nozzles for a cleaning liquid.

According to a preferred embodiment of the invention, said spray nozzles are provided with slotted openings disposed in a vertical plane.

According to the invention said spray nozzles are positioned in diametrically opposite relationship at the bottom side of the paddles such that not only the tank walls but also the front and back paddles are cleaned by the liquid squirted through the spray nozzles.

According to a preferred embodiment of the invention, one nozzle has a spread angle of 90°, another a spread angle of 60°.

By means of this cleaning apparatus wherein the spray apertures are disposed at the bottom end of the hollow stirring shaft and underneath the paddles in the tank, not only the paddles but also all openings and tubulures positioned at the top of the tank are optimally cleaned.

Since during cleaning of the tank the stirring gear drive is in operation, the principle of the invention is essentially that two flat, powerful jets of cleaning liquid having a spread angle of 90°, 60°, respctively, vigorously wash down from the bottom side of the stirring shaft any part of the tank and of the stirring gear.

One embodiment of the invention will now be described, by way of example, with reference to the accompanying drawings, wherein.

Figure 1:
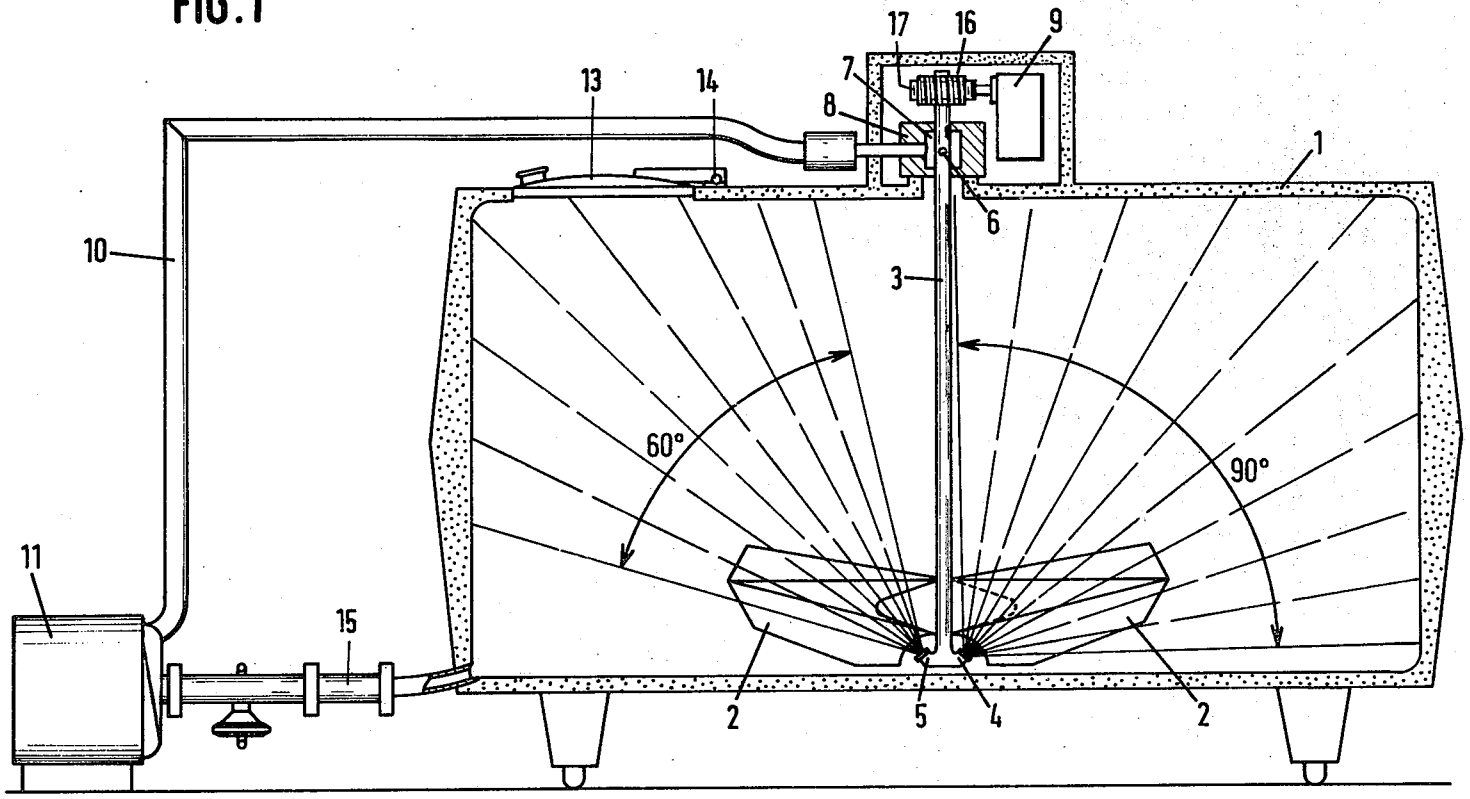
FIG. 1 is a vertical longitudinal section of a cooling tank provided with a stirring apparatus according to the invention.
Figure 2:
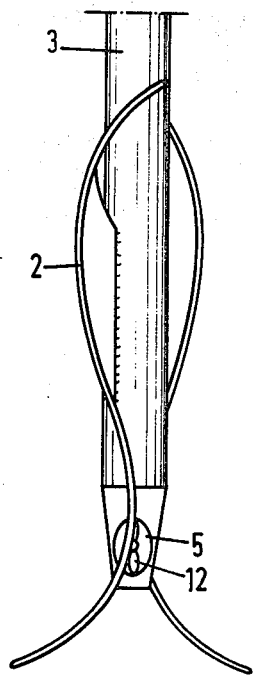
FIG. 2 is an end view of the stirring paddles of the apparatus.

In a tank 1, e.g. a milk cooling tank, there is disposed a stirring apparatus comprising two paddles 2 disposed at the bottom side of a shaft 3 and adjacent the bottom of the tank. The shaft 3 is hollow and provided at the bottom side with two opposite spray nozzles or orifices 4,5 directed radially outward from the shaft 3 and upward over the front and back sides of the paddles 2. The paddles 2 extend downward to at least the bottom of the shaft 3 and have cutouts adjacent the bottom of the shaft 3 to accommodate the nozzles, 4, 5 in the cutouts so that the nozzles are aligned with the paddles. The orifices are provided with slotted openings 12, the opening angle of the orifice 4 being about 90° and the opening angle of the orifice 5 about 60°. The end of the hollow shaft 3 projecting above the tank is provided with a bore 6 positioned in an annular chamber 7 of a housing 8 wherethrough the shaft 3 is conducted, watertight. At the top end the shaft 3 is provided with a worm gear 16 driven by a worm 17 on the drive shaft of a motor 9. To the housing 8 there is connected one end of liquid line 10 which communicates at its other end with a pump 11 for cleaning liquid. For cleaning the tank said liquid is pumped through pump 11 via liquid line 10, the annular chamber 7 and the hollow shaft 3, to the spray nozzle and through spray orifices 4,5 squirted upwardlly and outwardly in two vertical planes, in fan-shaped jets, the front and the back side of the paddles 2 being completely washed and cleaned, the cleaning liquid being moreover squirted against the inner wall of the tank. Since the stirring apparatus is driven during the cleaning of the tank the entire inner wall of the tank, including all apertures and tubulures, are cleaned by two powerful jets.

At the top of the cooling tank 1 there is disposed a cover 13 which is adapted to pivot about a pin 14. Furthermore the bottom end of the cooling tank 1 is connected by a discharge pipe 15 to the liquid pump 11 wherethrough the cleaning liquid squirted in the tank is pumped away again.

I claim:

1. A stirring apparatus for a liquid tank comprising a rotatingly driven hollow shaft extending downward in the tank, stirring paddles mounted on said shaft and extending radially from the shaft, means for applying a pressurized cleaning fluid into the upper end of the hollow shaft, said hollow shaft extending to adjacent the bottom of the tank, said paddles extending downward to at least the bottom of the shaft, said paddles having cutouts adjacent the bottom of the shaft, spray nozzles disposed on the bottom of the hollow shaft in said cutouts and aligned with said paddles, and said spray nozzles being directed radially outward and upward over the front and back sides of each of the stirring paddles such that the front and back sides of the paddles and the inside of the tank are cleaned by the cleaning liquid as the shaft is rotated.

2. A stirring apparatus according to claim 1, characterised in that the spray nozzles are provided with slotted openings disposed in a vertical plane.

3. A stirring apparatus according to claim 1, characterised in that the spread angle of one of the spray nozzles is 90° and of another nozzle 60°.

* * * * *

UNITED STATES PATENT AND TRADEMARK OFFICE

CERTIFICATE OF CORRECTION

PATENT NO. : 3,981,315

DATED : September 21, 1976

INVENTOR(S) : Klaas Olthoff

It is certified that error appears in the above-identified patent and that said Letters Patent are hereby corrected as shown below:

Page 1 after the line "[21] Appl. No.: 510,789" insert
-- [30] Foreign Application Priority Data
October 1, 1973 Netherlands. . . .7313470 --

Signed and Sealed this

Twenty-sixth Day of April 1977

[SEAL]

*Attest:*

RUTH C. MASON
*Attesting Officer*

C. MARSHALL DANN
*Commissioner of Patents and Trademarks*